US009268282B2

(12) United States Patent
Saito et al.

(10) Patent No.: US 9,268,282 B2
(45) Date of Patent: Feb. 23, 2016

(54) IMAGE FORMING APPARATUS AND IMAGE FORMING SYSTEM

(71) Applicant: CANON KABUSHIKI KAISHA, Tokyo (JP)

(72) Inventors: Yusuke Saito, Susono (JP); Kazutaka Yaguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/569,516

(22) Filed: Dec. 12, 2014

(65) Prior Publication Data

US 2015/0177665 A1 Jun. 25, 2015

(30) Foreign Application Priority Data

Dec. 19, 2013 (JP) ..... 2013-262771
Oct. 16, 2014 (JP) ..... 2014-211867

(51) Int. Cl.
*G03G 15/00* (2006.01)
*G03G 15/16* (2006.01)

(52) U.S. Cl.
CPC ..... *G03G 15/553* (2013.01); *G03G 15/5037* (2013.01); *G03G 15/1675* (2013.01)

(58) Field of Classification Search
CPC ..... G03G 15/0291; G03G 15/0266; G03G 2215/027; G03G 15/5037; G03G 15/02; G03G 15/0893; G03G 15/1675; G03G 5/14791; G03G 15/0853; G03G 15/0877; G03G 15/5058; G03G 2215/0129; G03G 2215/0822
See application file for complete search history.

(56) References Cited

U.S. PATENT DOCUMENTS

| | | | | |
|---|---|---|---|---|
| 5,485,248 | A | 1/1996 | Yano | |
| 6,892,317 | B1 * | 5/2005 | Sampath et al. | 714/4.3 |
| 2002/0034394 | A1 * | 3/2002 | Matsuguma et al. | 399/26 |
| 2003/0215253 | A1 * | 11/2003 | Okano et al. | 399/50 |

FOREIGN PATENT DOCUMENTS

| | | | |
|---|---|---|---|
| JP | H08-241018 | A | 9/1996 |
| JP | 2000-347545 | A | 12/2000 |
| JP | 2006-208477 | A | 8/2006 |
| JP | 2011-197567 | A | 10/2011 |

* cited by examiner

*Primary Examiner* — Roy Y Yi
(74) *Attorney, Agent, or Firm* — Canon USA, Inc. IP Division

(57) ABSTRACT

An image forming apparatus includes an image bearing member, a process member that acts on the image bearing member, a voltage application unit that applies a voltage to the process member, a current detection unit that detects an electric current that flows to the image bearing member, and a control unit that causes the voltage application unit to apply voltages respectively having positive and negative polarities to the process member, to determine a surface potential of the image bearing member based on a detection result acquired by the current detection unit, and to output information about a usage amount of the image bearing member according to the determined result.

9 Claims, 12 Drawing Sheets

RELATIONSHIP BETWEEN APPLIED VOLTAGE AND DISCHARGE CURRENT

RELATIONSHIP BETWEEN APPLIED VOLTAGE AND DRUM POTENTIAL

WHEN PHOTOSENSITIVE DRUM IS NORMAL

WHEN PHOTOSENSITIVE DRUM IS ABNORMAL

WHEN PHOTOSENSITIVE DRUM IS NORMAL

WHEN PHOTOSENSITIVE DRUM IS ABNORMAL

| PRINTER | SHIPPING INFORMATION |
|---|---|
| 301a | SCHEDULED SHIPPING DATE: 2/5 |
| 301b | SCHEDULED SHIPPING DATE: 5/15 |
| 301c | SCHEDULED SHIPPING DATE: 7/20 |

IMAGE FORMING APPARATUS AND IMAGE FORMING SYSTEM

BACKGROUND

1. Field

Aspects of the present invention generally relate to an image forming apparatus including a function of detecting a surface potential of an image bearing member on which a latent image is formed.

2. Description of the Related Art

An electrophotographic image forming apparatus includes a photosensitive drum serving as an image bearing member. The photosensitive drum is used when the image forming apparatus forms an electrostatic latent image and develops the formed electrostatic latent image with toner to form a developer image (image). When the electrostatic latent image is formed on the photosensitive drum, a surface of the photosensitive drum needs to be charged. A charge amount necessary to charge the surface of the photosensitive drum is changed depending on various factors such as environment in which the image forming apparatus is used, a film thickness and sensitivity of the photosensitive drum, and a variation of circuit elements in, for example, a high-voltage circuit used for a charging operation. A change in the charge amount causes a variation in a potential difference (also called a back contrast) between the charge amount of the photosensitive drum and a development voltage (also called a development bias) used to develop the latent image with toner. Such a variation may degrade image quality or affect a toner consumption amount.

Moreover, when the photosensitive drum has been used for a long time, a surface layer of the photosensitive drum becomes abraded. This significantly decreases a charge amount, causing degradation in image quality including generation of a defective image and a decrease in image density.

Japanese Patent Application Laid-Open No. 2000-347545 discusses a method for suppressing image quality degradation due to deterioration in the photosensitive drum. According to this method, a surface potential of the photosensitive drum is detected by a surface potential measuring unit, and an image forming condition is controlled according to the detection result.

However, the method using the surface potential measuring unit discussed in Japanese Patent Application Laid-Open No. 2000-347545 can only detect a local potential on the photosensitive drum. Consequently, in a case where the surface potential measuring unit detects a surface potential of the photosensitive drum with dust and toner attached to the surface of the photosensitive drum, the surface potential cannot be accurately detected. Thus, it has been desired that the surface potential of the photosensitive drum is detected with accuracy regardless of the surface state of the photosensitive drum.

SUMMARY

According to an aspect of the present invention, an image forming apparatus includes an image bearing member, a charging member configured to charge the image bearing member, a transfer member configured to transfer an image formed on the image bearing member, a voltage application unit configured to apply a voltage to the transfer member, a current detection unit configured to detect an electric current that flows to the image bearing member, and a control unit configured to cause the voltage application unit to apply voltages respectively having positive and negative polarities to the transfer member, to determine a surface potential of the image bearing member based on a detection result acquired by the current detection unit, and to output information about a usage amount of the image bearing member according to the determined result.

Further features of the present disclosure will become apparent from the following description of exemplary embodiments with reference to the attached drawings.

DESCRIPTION OF THE EMBODIMENTS

Various exemplary embodiments will be described in detail below with reference to the drawings.

Figure 10:
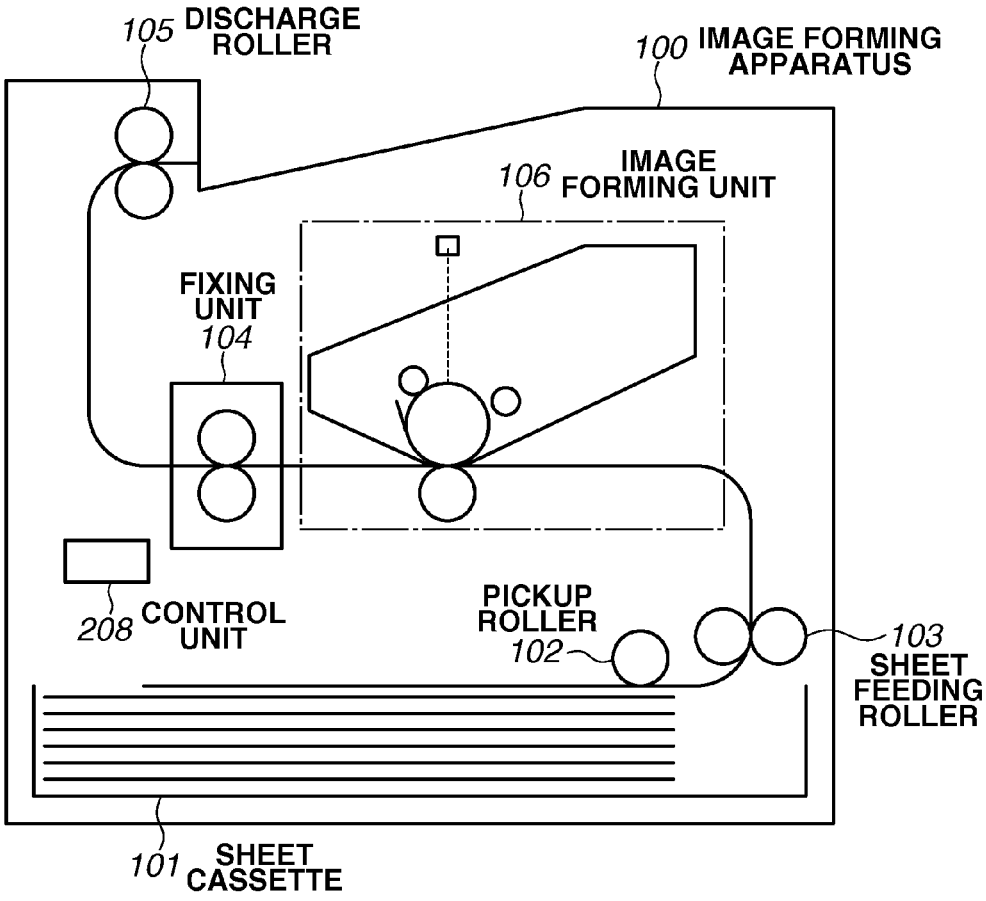
FIG. 10 is a schematic diagram illustrating an image forming apparatus according to an exemplary embodiment.

FIG. 10 is a schematic diagram illustrating an image forming apparatus 100 according to a first exemplary embodiment. The image forming apparatus 100 illustrated in FIG. 10 is an electrophotographic laser beam printer. The image forming apparatus 100 includes a sheet cassette 101 in which sheets are set, a pickup roller 102 for supplying a sheet, a sheet feeding roller 103 for conveying the sheet, a fixing unit 104 for fixing toner onto the sheet, and a discharge roller 105 for discharging the sheet. Moreover, the image forming apparatus 100 includes an image forming unit 106 that performs charging and exposure operations, for example. A sheet stacked on the sheet cassette 101 is picked up by the pickup roller 102, and then conveyed by the sheet feeding roller 103 and a drive unit including a motor (not illustrated). The image forming unit 106 transfers a toner image to the sheet, and the fixing unit 104 fixes the toner image onto the sheet. Subsequently, the discharge roller 105 discharges the sheet to the outside of the image forming apparatus 100. These operations are controlled by a control unit 208 that controls operational sequence of the image forming apparatus 100. A term "sheet"

used in the image forming apparatus 100 of the present exemplary embodiment includes a sheet of paper and an overhead projector (OHP) sheet on which a toner image can be formed.

Figure 1:
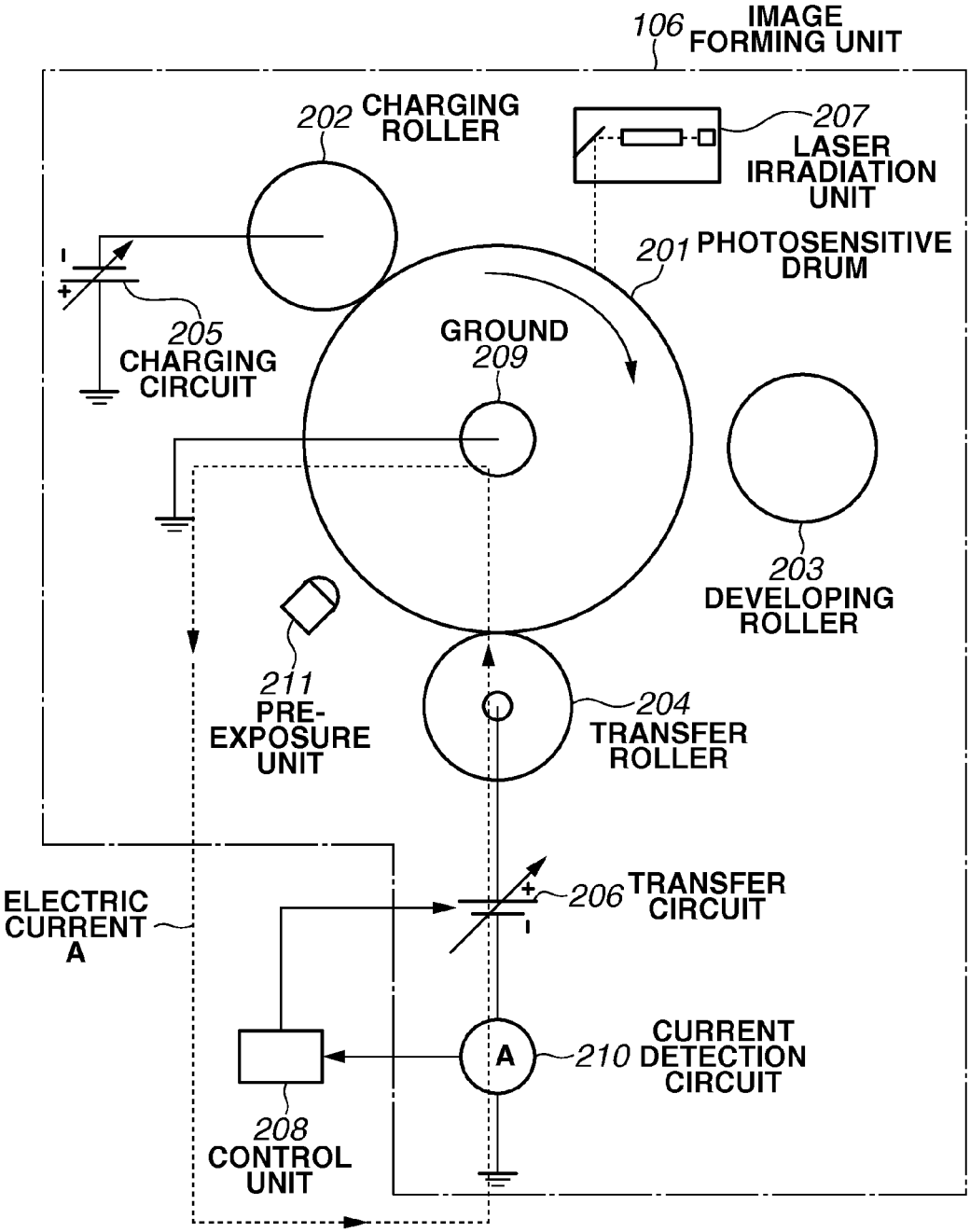
FIG. 1 is a schematic diagram illustrating an image forming unit according to an exemplary embodiment.

The image forming unit 106 is described in detail with reference to FIG. 1. The image forming unit 106 includes a photosensitive drum 201 serving as an image bearing member, and a charging roller 202 serving as a charging member. The charging roller 202 uniformly charges a surface of the photosensitive drum 201. Moreover, the image forming unit 106 includes a developing roller 203 serving as a development member, and a transfer roller 204 serving as a transfer member. The developing roller 203 supplies toner to an electrostatic latent image formed on the surface of the photosensitive drum 201. The transfer roller 204 transfers the toner image formed on the photosensitive drum 201 to a sheet. The charging roller 202, the developing roller 203, and the transfer roller 204 are one example of a process member that acts on the photosensitive drum 201.

Moreover, the image forming unit 106 includes a charging circuit 205 and a transfer circuit 206. The charging circuit 205 serving as a voltage application unit applies a voltage to the charging roller 202, and the transfer circuit 206 serving as a voltage application unit applies a voltage to the transfer roller 204. Moreover, the image forming unit 106 includes a laser irradiation unit 207 and a pre-exposure unit 211. The laser irradiation unit 207 forms an electrostatic latent image on the photosensitive drum 201, and the pre-exposure unit 211 uniformly irradiates the surface of the photosensitive drum 201 with light.

The transfer circuit 206 can change a voltage value (bias value) that is output by the control unit 208 serving as a controller for controlling the operational sequence of the image forming apparatus 100. A current detection circuit 210 serving as a current detection unit detects an electric current A that flows along the transfer roller 204, the photosensitive drum 201, and a ground 209 from the transfer circuit 206. In such a configuration, the control unit 208 controls image forming operations including the charging operation for the photosensitive drum 201 and the exposure operation performed by the laser irradiation unit 207, based on a program stored in a read only memory (ROM) that is not illustrated.

In the present exemplary embodiment, the charging circuit 205 generates a predetermined charging voltage (charging bias) Vc. This charging voltage Vc is applied to the photosensitive drum 201 so as to uniformly charge the photosensitive drum 201 by the charging roller 202. The transfer circuit 206 serving as a constant-voltage power source generates a transfer voltage (transfer bias) to be applied to the transfer roller 204. The transfer voltage is changeable to a positive polarity and a negative polarity. When the transfer bias is applied to the transfer roller 204, the image forming apparatus 100 detects a value of the electric current which flows to the photosensitive drum 201 through the transfer roller 204. The image forming apparatus 100 determines a usage state of the photosensitive drum 201 based on a result of the current detection. In other words, the image forming apparatus 100 includes a determination unit for determining a usage amount (lifetime, time for replacement) of the photosensitive drum 201.

Figure 2:
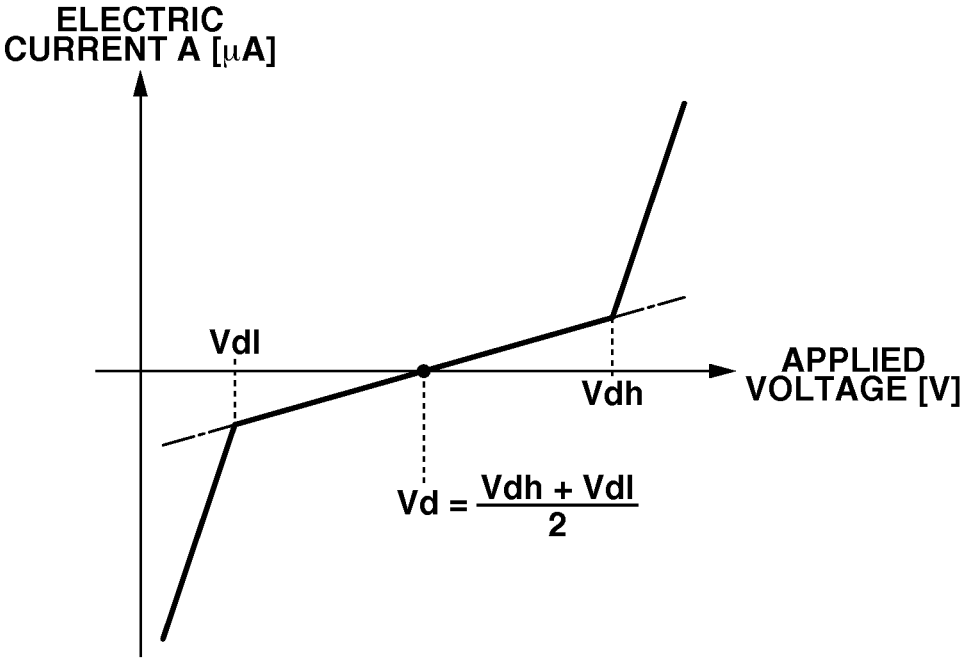
FIG. 2 is a graph illustrating a relationship between a voltage applied to a transfer roller and an electric current that flows to a photosensitive drum.

Hereinafter, characteristics of the image forming apparatus 100 according to the present exemplary embodiment are described in detail. FIG. 2 illustrates an example of a relationship between a voltage that is applied to the transfer roller 204 disposed opposing the photosensitive drum 201 and an electric current A which flows to the photosensitive drum 201. The relationship illustrated in FIG. 2 is obtained when a surface of the photosensitive drum 201 is charged to a predetermined potential, and then the voltage to be applied to the transfer roller 204 is changed. In FIG. 2, a horizontal axis indicates the voltage which is applied to the transfer roller 204, whereas a vertical axis indicates the electric current A which flows to the photosensitive drum 201. A potential difference between the surface of the photosensitive drum 201 and the transfer roller 204 increases as the voltage applied to the transfer roller 204 is changed. When the potential difference exceeds a certain value, a discharge between the photosensitive drum 201 and the transfer roller 204 starts. Such a discharge allows a large current to flow. This inflection point is defined as a discharge start voltage.

With the relationship illustrated in FIG. 2, the control unit 208 detects electric current values acquired by the current detection circuit 210 when voltages are applied to the transfer roller 204 during a non-image range (a period in which an image is not formed). Subsequently, the control unit 208 measures a discharge start voltage between the photosensitive drum 201 and the transfer roller 204 based on each of the detected current values. The control unit 208 calculates a surface potential on the photosensitive drum 201 using the measurement result, and determines a state of the photosensitive drum 201 based on the calculation result.

Figure 3:
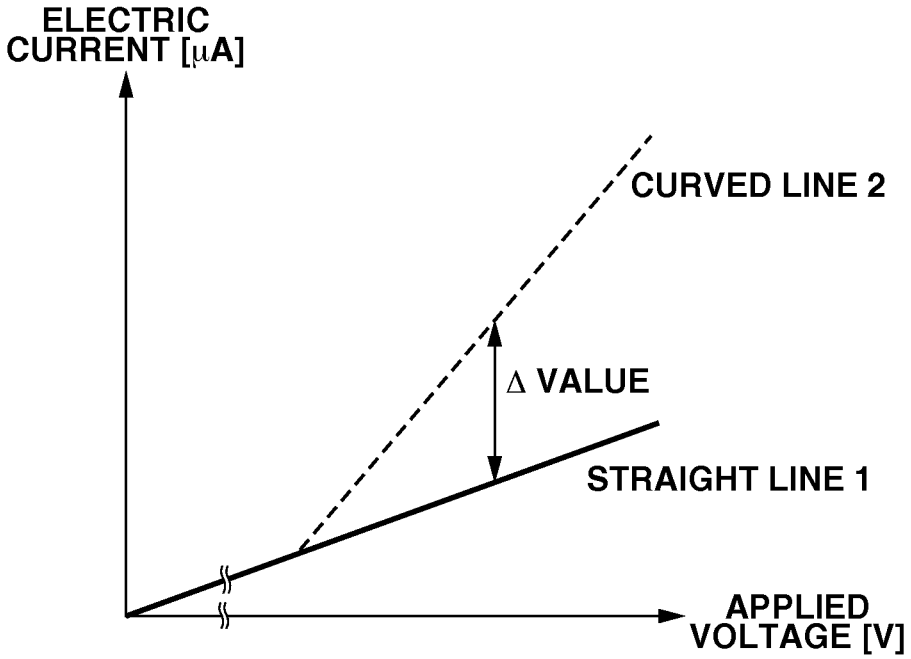
FIG. 3 is an enlarged view of a portion of the relationship between the applied voltage and the electric current illustrated in FIG. 2.

The inflection point illustrated in FIG. 2 can be determined by calculating a discharge current generated by the discharge between the photosensitive drum 201 and the transfer roller 204 from a Δ value illustrated in FIG. 3. This calculation is an example of an inflection point determination. FIG. 3 is an enlarged view of a portion of the relationship between the applied voltage and the electric current A illustrated in FIG. 2. The portion illustrates the relationship immediately before the discharge.

Figure 4A:
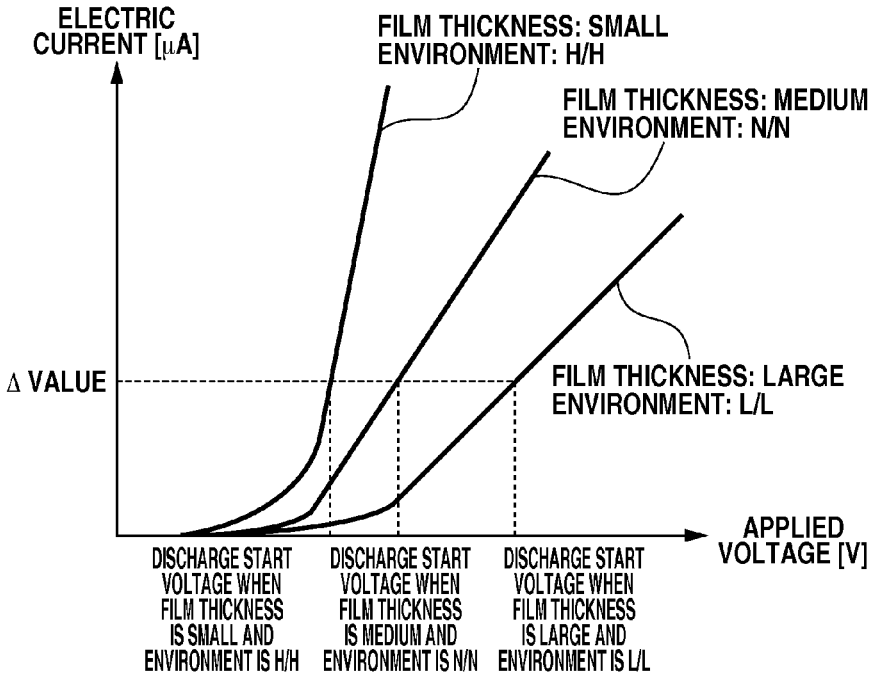
FIGS. 4A and 4B are graphs illustrating a discharge start voltage between the photosensitive drum and the transfer roller.
Figure 4B:
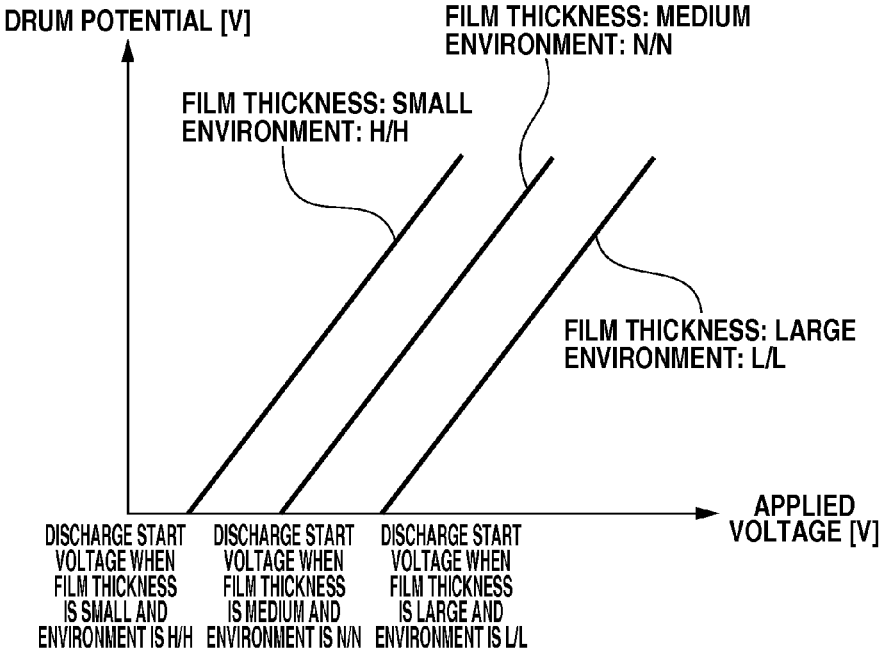

In FIG. 3, a straight line 1 indicates a change in the electric current values before the discharge starts, whereas a curved line 2 indicates a change in the electric current values after the discharge starts. Therefore, the A value indicating a difference between the straight line 1 and the curved line 2 represents a discharge current. The control unit 208 determines that a point at which the A value becomes a desired current is a discharge start voltage. The straight line 1 and the curved line 2 varies depending on a film thickness of the photosensitive drum 201 and environment as illustrated in FIGS. 4A and 4B. FIG. 4A is a diagram illustrating a relationship between a transfer bias applied to the transfer roller 204 and a discharge current. As illustrated in FIG. 4A, voltages (i.e., discharge start voltages) providing the same Δ value vary depending on film thickness, ambient temperature, and humidity. Hence, as illustrated in FIG. 4B, each relationship between the transfer bias applied to the transfer roller 204 and a surface potential of the photosensitive drum 201 differs depending on the film thickness, the ambient temperature, and the humidity.

Accordingly, as for the Δ value used to determine the starting of the discharge, a discharge current value can be stably detected in consideration of the film thickness of the photosensitive drum 201, the ambient temperature, and the humidity. Moreover, the Δ value providing a correlation with the discharge start voltage can be set. The Δ value used to determine the starting of the discharge is stored beforehand in a storage unit (not illustrated) of the control unit 208.

As discharge characteristics of the photosensitive drum 201, a potential difference needed for the discharge varies depending on the environment and the film thickness of the photosensitive drum 201. Meanwhile, if the conditions (e.g., environment and film thickness) of the photosensitive drum 201 (device) are substantially the same, a potential difference necessary to start the discharge is symmetric for positive and negative with respect to a potential of the photosensitive drum 201. Such a characteristic is known as a discharge phenomenon.

Assuming that the transfer roller 204 and the photosensitive drum 201 have a gap between planes, the gap has the discharge characteristics as mentioned above. A surface potential of the photosensitive drum 201 can be determined by an equation 1.

$$Vd = \left(\frac{Vdh + Vdl}{2}\right) \quad \text{Equation 1}$$

where Vd is a surface potential of the photosensitive drum 201, Vdh is a discharge start voltage on the positive side relative to a surface potential of the photosensitive drum 201, and Vdl is a discharge start voltage on the negative side relative to the surface potential of the photosensitive drum 201. Then the surface potential Vd of the photosensitive drum 201 can be determined by dividing the sum of Vdh and Vdl by 2.

Figure 5:
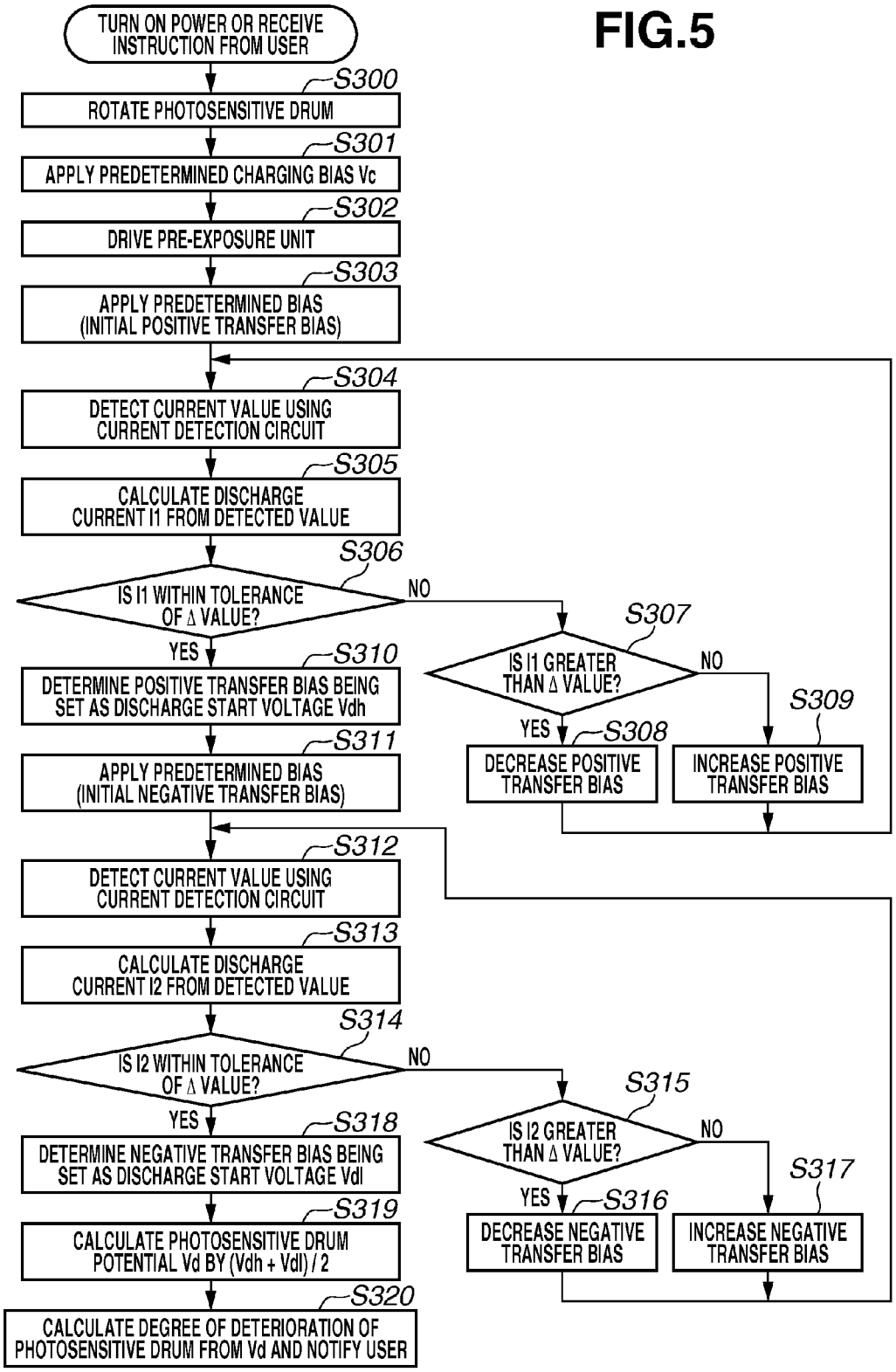
FIG. 5 is a flowchart illustrating processing performed by a control unit according to a first exemplary embodiment.

FIG. 5 is a flowchart illustrating an example of processing performed when the control unit 208 calculates the surface potential Vd of the photosensitive drum 201, which is obtained when the a predetermined charging bias Vc is applied. Prior to a series of the following control processing, the pre-exposure unit 211 irradiates the photosensitive drum 201 with light to electrically discharge a residual potential on the photosensitive drum 201 after the photosensitive drum 201 and the transfer roller 204 contact with each other. In the present exemplary embodiment, the pre-exposure unit 211 is used as a unit for electrically discharging the residual potential. Alternatively, various units may be used. For example, the image forming apparatus 100 may use a unit for charging a potential of the photosensitive drum 201 to zero volt (0 V) with an alternating current (AC) bias.

When the image forming apparatus 100 is turned on, or receives an image forming instruction from a user, the operation proceeds to step S300. In step S300, the control unit 208 activates the photosensitive drum 201 to rotate. In step S301, the control unit 208 causes a predetermined charging bias Vc to be applied to the photosensitive drum 201 during a non-image period in an initial operation (also called a pre-multi-rotation or a pre-rotation). Subsequently, in step S302, the control unit 208 drives the pre-exposure unit 211 by using a predetermined driving signal, so that the pre-exposure unit 211 irradiates the photosensitive drum 201 with light. In step S303, the control unit 208 causes a predetermined positive transfer bias having a positive polarity to be applied to the photosensitive drum 201. In step S304, the control unit 208 causes the current detection circuit 210 to detect the electric current A, which flows to the photosensitive drum 201, with the predetermined positive transfer bias applied. In step S305, according to the above theory, the control unit 208 calculates a discharge current I1 from the value detected by the current detection circuit 210 in step S304. In step S306, the control unit 208 compares the discharge current I1 and an absolute value of the Δ value, and determines whether the discharge current I1 is within a tolerance of the Δ value. If the discharge current I1 is not within the tolerance of the Δ value (NO in step S306), the operation proceeds to step S307. In step S307, the control unit 208 determines whether the discharge current I1 is greater than the Δ value. If the discharge current I1 is greater than the Δ value (YES in step S307), then in step S308, the control unit 208 decreases the absolute value of the positive transfer bias. Subsequently, the operation returns to step S304. If the discharge current I1 is not greater than the Δ value (NO in step S307), then in step S309, the control unit 208 increases the absolute value of the positive transfer bias. Then, the operation returns to step S304. The control unit 208 repeats the operations from step S307 to S308 or step S309 until the discharge current I1 is determined to be within the tolerance of the Δ value. If the control unit 208 determines that the discharge current I1 is within the tolerance of the Δ value (YES in step S306), the operation proceeds to step S310. In step S310, the control unit 208 determines that the positive transfer bias set in step S308 or step S309 serves as a discharge start voltage Vdh on the positive side.

Subsequently, in step S311, the control unit 208 causes a predetermined negative transfer bias having a negative polarity to be applied. Then, the control unit 208 executes the operations from step S312 to step S317 that are similar to those from step S304 to step S309 except for the negative polarity side. In step S314, if the control unit 208 determines that a discharge current 12 is within tolerance of a Δ value (YES in step S314), the operation proceeds to step S318. In step S318, the control unit 208 determines that the negative transfer bias set in step S316 or step S317 serves as a discharge start voltage Vdl on the negative side.

In step S319, the control unit 208 calculates the surface potential Vd of the photosensitive drum 201 by dividing the sum of the discharge start voltage Vdh and the discharge start voltage Vdl by 2. In step S320, the control unit 208 calculates the degree of deterioration of the photosensitive drum 201 from the charging bias Vc and a change in the potential Vd of the photosensitive drum 201. The control unit 208 notifies the user of the remaining lifetime of the photosensitive drum 201 through a display unit (not illustrated) according to the calculated degree of deterioration. If the control unit 208 determines that the calculated degree of deterioration exceeds the life of the photosensitive drum 201, the control unit 208 warns and urges the user to replace the photosensitive drum 201. A change in durability of the photosensitive drum 201 over time is described in detail below with reference to FIG. 6 or subsequent drawings.

With such control operations, the control unit 208 can calculate the potential Vd of the photosensitive drum 201 when the predetermined charging bias Vc is applied thereto. Moreover, the control unit 208 can notify the user of a usage amount (lifetime) of the photosensitive drum 201 by outputting a warning at appropriate timing.

Next, a relationship between the surface potential of the photosensitive drum 201 when the predetermined charging bias Vc is applied thereto and the drive time in terms of a usage amount of the photosensitive drum 201 is described in detail with reference to FIG. 6.

First, the durability of the photosensitive drum 201 is described. In a case where the photosensitive drum 201 is used continuously, a surface layer thereof is gradually abraded and a film thickness thereof becomes thinner. This deteriorates chargeability of the photosensitive drum 201. If the chargeability is deteriorated, a surface potential on the photosensitive drum 201 cannot remain at a predetermined potential level, causing degradation in quality of an image to be developed (toner image). Accordingly, a relationship between the surface potential and drive time (with respect to accumulated time of use) as durability of the photosensitive drum 201 differs depending on usage conditions of the photosensitive drum 201.

The durability of the photosensitive drum 201 may be changed by a difference in how the photosensitive drum 201 of the image forming apparatus 100 is used by a user. Such a change in durability is described as a first example case. In FIG. 6, a line "a" indicates a relationship between a potential on a photosensitive drum 201 and drive time when the photosensitive drum 201 is used in a standard manner. In FIG. 6, the predetermined charging bias Vc is applied, and the photosensitive drum 201 is used continuously. According to the graph illustrated in FIG. 6, if a surface potential of the photosensitive drum 201 becomes a threshold value Vx or below, the photosensitive drum 201 reaches the end of life. Herein, time Ta illustrated in FIG. 6 indicates the end of life. In a range X provided after the time Ta, generation of a defective image including degradation in image quality may occur. In the present exemplary embodiment, the control unit 208 is set to warn the user of the end of life of the photosensitive drum 201 when the surface potential of the photosensitive drum 201 reaches the range X.

Figure 6:
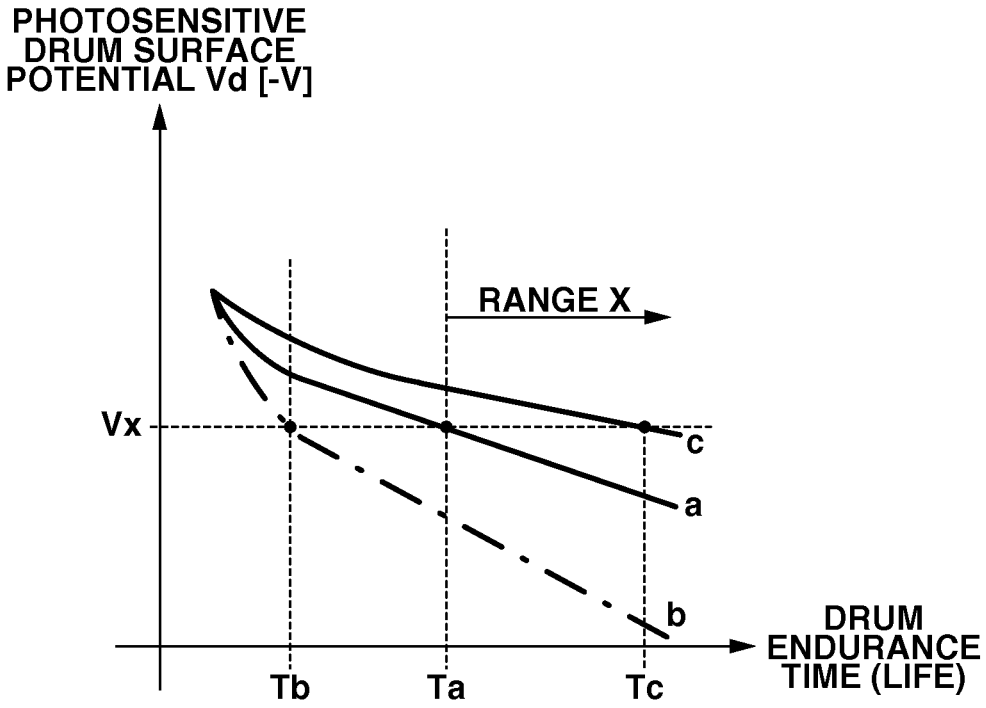
FIG. 6 is a graph illustrating a relationship between a surface potential and drive time of the photosensitive drum.

Next, a line in FIG. 6 indicates a relationship between a potential on a photosensitive drum 201 and drive time when the photosensitive drum 201 is used in a manner resulting in a higher degree of deterioration than when used in the standard manner indicated by the line "a". On the other hand, a line "c" in FIG. 6 indicates a relationship between a potential on a photosensitive drum 201 and drive time when the photosensitive drum 201 is used in a manner resulting in a lower degree of deterioration than when used in the standard manner. Herein, if a lifetime of each of the photosensitive drums 201 is determined based on the drive time Ta by usage in the standard manner, the photosensitive drum 201 indicated by the line "b" reaches the end of lifetime at time Tb that is earlier than the time Ta of the line "a". Thus, when the photosensitive drum 201 is used as the line "b", a defective image may be generated earlier than when used in the standard manner indicated by the line "a". On the other hand, although the photosensitive drum 201 indicated by the line "c" could be used until time Tc, which is longer than when used in the standard manner, the image forming apparatus 100 gives a warning to the user earlier than the end of lifetime of the photosensitive drum 201 due to the time Ta. In the present exemplary embodiment, conditions of differences in usage of the photosensitive drum 201 by a user can be set from parameters such as accumulated rotation time of the photosensitive drum 201, exposure time of the pre-exposure unit 211, and accumulated time of application of a charging bias to the charging roller 202.

In the present exemplary embodiment, therefore, when the surface potential Vd of the photosensitive drum 201 becomes the value Vx calculated above, the control unit 208 can determine that the photosensitive drum 201 has reached the end of lifetime. More specifically, when the photosensitive drum 201 is used in the manner resulting in a higher degree of deterioration than when used in the standard manner, the control unit 208 can determine that the photosensitive drum 201 has reached the end of lifetime at time Tb. On the other hand, when the photosensitive drum 201 is used in the manner resulting in a lower degree of deterioration than when used in the standard manner, the control unit 208 can determine that the photosensitive drum 201 has reached the end of lifetime at time Tc. Therefore, when the surface potential Vd of the photosensitive drum 201 becomes the value Vx calculated above, the control unit 208 can warn the user of a lifetime of the photosensitive drum 201 at appropriate timing in consideration of the lifetime and a change in characteristics of usage conditions of the photosensitive drum 201.

Figure 7:
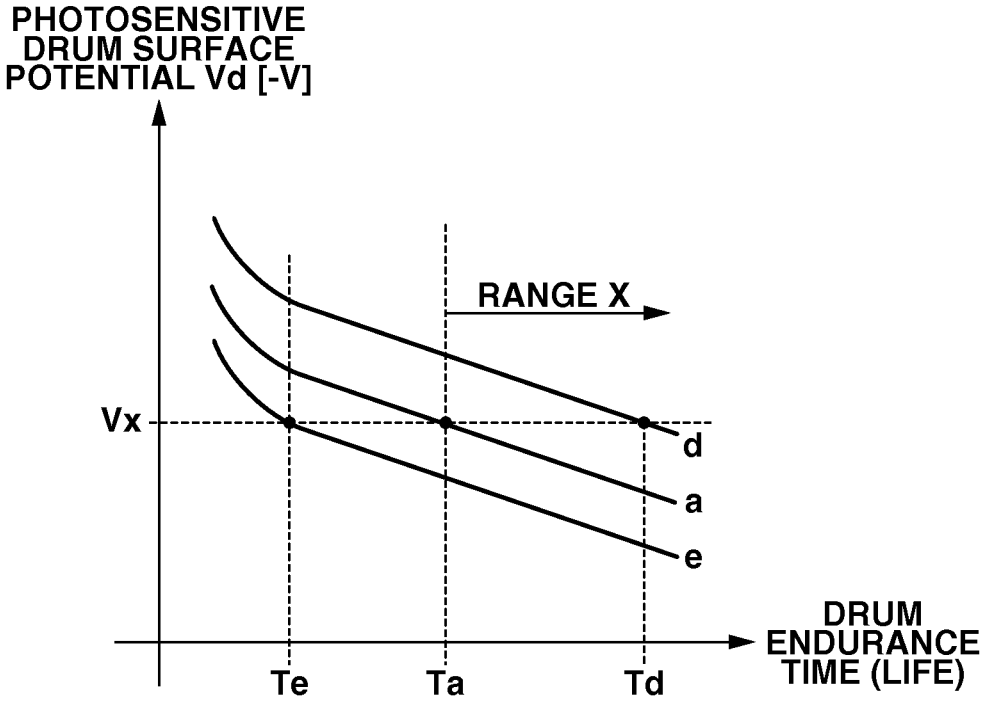
FIG. 7 is a graph illustrating a relationship between a surface potential and drive time of the photosensitive drum.

In addition, the durability of the photosensitive drum 201 may be changed by a variation in film thickness of the photosensitive drum 201. Such a change in durability is described as a second example case. FIG. 7 is a graph illustrating a relationship between drive time and a surface potential Vd of the photosensitive drums 201 in a case where a film thickness of each photosensitive drum 201 differs. In FIG. 7, a line "a" indicates characteristics of a surface potential Vd with respect to drive time of a photosensitive drum 201 including a film having a standard thickness. In FIG. 7, a line "d" indicates characteristics of a photosensitive drum 201 that has a thicker film than that of the standard film. In FIG. 7, a line "e" indicates characteristics of a photosensitive drum 201 that has a thinner film than that of the standard film. Herein, if a lifetime of each of the photosensitive drums 201 is determined based on the drive time Ta of the photosensitive drum 201 including the standard thickness film, problems similar to the above-described first example case may be concerned. More specifically, depending on a difference in film thickness of the photosensitive drum 201, the control unit 208 may warn the user of the end of lifetime of the photosensitive drum 201 after a surface potential of the photosensitive drum 201 reaches a range X in which a defective image may be generated, or may issue warning even if the photosensitive drum 201 has not yet reached the end of lifetime.

Consequently, similar to the first example case, the control unit 208 needs to be set to warn the user of a lifetime of the photosensitive drum 201 at a different timing according to a difference in film thickness. Thus, in consideration of a change in characteristics of the photosensitive drum 201, the control unit 208 can warn the user of a lifetime of the photosensitive drum 201 at appropriate timing regardless of the difference in film thickness of the photosensitive drums 201. In the image forming apparatus 100 according to the present exemplary embodiment, therefore, a surface potential Vd of the photosensitive drum 201 can be accurately detected. This enables deterioration of the photosensitive drum 201 to be detected regardless of usage of the photosensitive drum 201 by a user, environment, or a variation generated during a manufacturing process such as a variation in film thickness of photosensitive drums. Thus, the image forming apparatus 100 can reliably notify the user of a correct lifetime of the photosensitive drum 201, and urge the user to replace the photosensitive drum 201 at appropriate timing.

In particular, when a difference in how the photosensitive drum 201 is used by a user is considered, there is an advantage that the user can be notified of a lifetime of the photosensitive drum 201 at appropriate timing according to a usage state. Hence, the photosensitive drum 201 can be used effectively. Moreover, the photosensitive drum 201, the charging roller 202, and the developing roller 203 can be integrated as a process cartridge (a consumable product). In such a case, the process cartridge can be attachable to and detachable from the image forming apparatus 100. This is an effective way to notify the user of replacement of the process cartridge at appropriate timing when the photosensitive drum 201 reaches the end of lifetime.

Moreover, in the present exemplary embodiment, a surface potential of the photosensitive drum 201 is calculated from a detected value of an electric current that is caused to flow by applying a transfer bias to the transfer roller 204. Such calculation differs from the measurement of a local potential using the surface potential measuring unit as discussed in Japanese Patent Application Laid-Open No. 2000-347545. More specifically, in the calculation according to the present exemplary embodiment, the transfer roller 204 which contacts the photosensitive drum 201 across a longitudinal direction (a direction perpendicular to a rotation direction) is used. This enables detection of a state of the potential on an area in a longitudinal direction of the photosensitive drum 201.

Therefore, the surface potential can be calculated with accuracy even if dust and toner are locally attached to the photosensitive drum 201.

In the present exemplary embodiment, when the surface potential of the photosensitive drum 201 exceeds the threshold value Vx, the control unit 208 determines that the photosensitive drum 201 has reached the end of lifetime. However, the degree of deterioration and the lifetime of the photosensitive drum 201 may be determined based on a $\Delta V$ that is a change in the potential of the photosensitive drum 201 from an initial potential.

In the present exemplary embodiment, the detection of the discharge current is described using the charging roller 202 and the transfer roller 204 as an example. However, charging and discharging may be alternately performed by only the charging roller 202. Moreover, a discharging dedicated roller may be disposed in addition to the charging roller 202 and the transfer roller 204 to execute control processing according to the present exemplary embodiment.

Next, an image forming apparatus according to a second exemplary embodiment is described. Since configuration of the image forming apparatus of the second exemplary embodiment is similar to that of the first exemplary embodiment, similar components are given the same reference numerals as those of the first exemplary embodiment, and description thereof is omitted. Unlike the first exemplary embodiment, a control unit 208 of the second exemplary embodiment determines that a photosensitive drum 201 has an abnormality if a current detection circuit 210 detects an electric current having an abnormal value. Herein, the term "abnormality" represents a state that an abnormality such as a scratch and a pinhole is generated on the photosensitive drum 201.

Figure 8A:
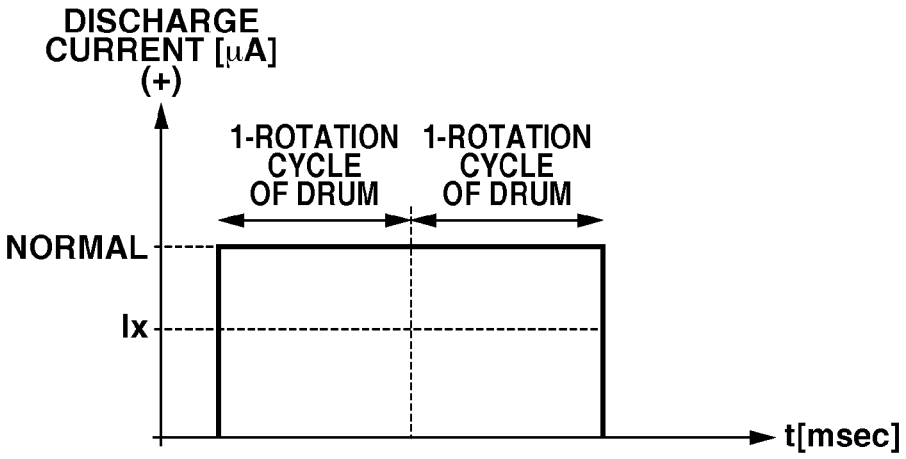
FIGS. 8A and 8B are graphs each illustrating characteristics of an electrical potential of a surface of the photosensitive drum.
Figure 8B:
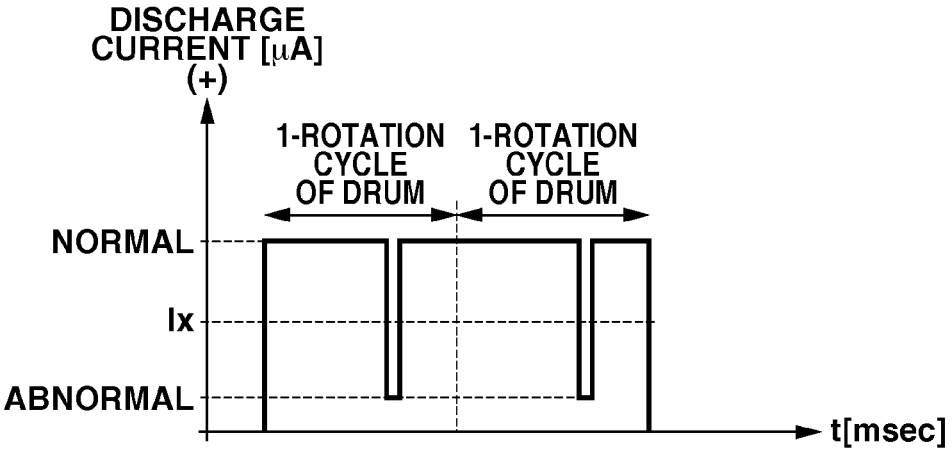

A case in which a positive transfer bias is applied to a transfer roller 204 is described as a first example case. FIGS. 8A and 8B are graphs illustrating a discharge current that flows when a predetermined positive transfer bias is applied to the transfer roller 204 disposed opposing the photosensitive drum 201. In each of FIGS. 8A and 8B, a horizontal axis indicates time t [msec], whereas a vertical axis indicates a discharge current [μ]. A potential difference between a surface potential Vd of the photosensitive drum 201 and the transfer positive bias applied to the transfer roller 204 is large enough for a discharge current to flow. Each of FIGS. 8A and 8B indicates that the photosensitive drum 201 has an abnormality if an electric current detected by the current detection circuit 210 is a threshold value Ix or below.

FIG. 8A illustrates characteristics of the discharge current when the photosensitive drum 201 is normal. The discharge current flows when a positive transfer bias is applied to the transfer roller 204 for a period corresponding to time needed for two rotations (two rotation cycles) of the photosensitive drum 201 (after a negative charging bias Vc is applied). Since the potential difference between the surface potential Vd of the photosensitive drum 201 and the transfer roller 204 is large enough for discharging, the discharge current uniformly flows over the entire surface of the photosensitive drum 201. On the other hand, FIG. 8B is a graph illustrating characteristics of a discharge current when a surface of the photosensitive drum 201 has an abnormality such as a scratch and a pinhole. If there is a scratch or a pinhole on the surface of the photosensitive drum 201, an electric charge cannot be held in such an area. Therefore, as illustrated in FIG. 8B, even when the abnormal area having a scratch or a pinhole faces the transfer roller 204, the discharge current does not flow. As a result, the current to be detected by the current detection circuit 210 becomes lower than the threshold value Ix, so that an abnormality of the photosensitive drum 201 can be detected.

Figure 9A:
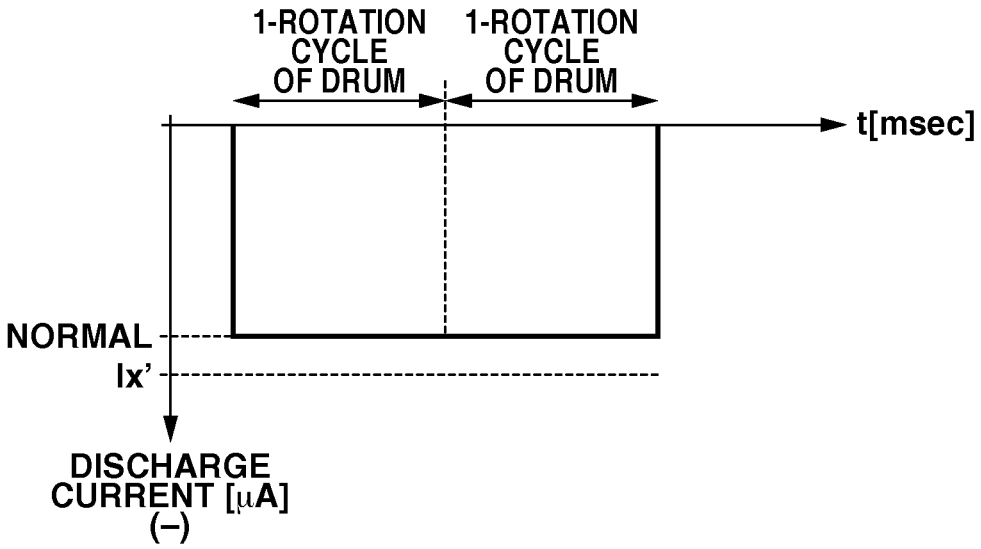
FIGS. 9A and 9B are graphs each illustrating characteristics of an electrical potential of a surface of the photosensitive drum.
Figure 9B:
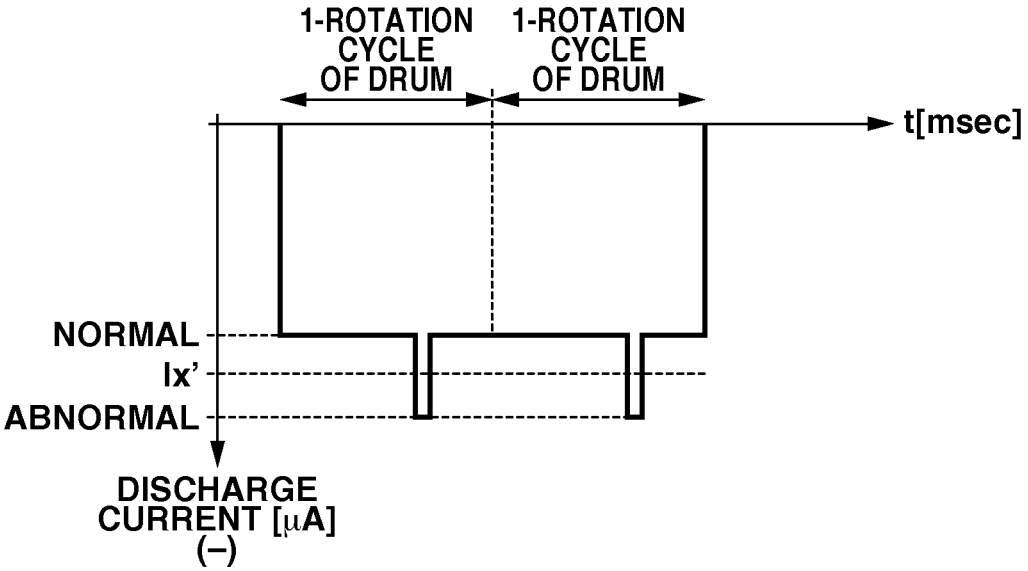

Next, a description is given of a case where a negative transfer bias is applied to the transfer roller 204 as a second example case of the second exemplary embodiment. FIGS. 9A and 9B are graphs illustrating a discharge current that flows when a predetermined negative transfer bias is applied to the transfer roller 204 disposed opposing the photosensitive drum 201. Each of FIGS. 9A and 9B indicates that the photosensitive drum 201 has an abnormality if an electric current detected by the current detection circuit 210 is a threshold value Ix' or below. FIG. 9A illustrates characteristics of the discharge current and time when the photosensitive drum 201 is normal. FIG. 9B illustrates characteristics of the discharge current and time when a surface of the photosensitive drum 201 has an abnormality such as a scratch and a pinhole.

Similar to the first example case, the current detection circuit 210 detects an electric current that flows to the photosensitive drum 201, so that an abnormality can be detected. Accordingly, as illustrated in FIG. 9B, when the photosensitive drum 201 has the abnormality such as a scratch or a pinhole, the discharge current becomes hard to flow. Thus, the current to be detected by the current detection circuit 210 becomes lower than the threshold value Ix', so that an abnormality of the photosensitive drum 201 can be detected.

According to the present exemplary embodiment, therefore, after the predetermined charging bias Vc is applied to the photosensitive drum 201, the current detection circuit 210 detects the electric current that flows to the photosensitive drum 201. This enables the abnormal current to be detected. If the current detection circuit 210 detects the abnormal current, the control unit 208 determines that the surface of the photosensitive drum 201 has a scratch or a pinhole. Then, the control unit 208 can urge the user to replace the photosensitive drum 201.

According to the present exemplary embodiment, an abnormality such as a scratch and a pinhole on the photosensitive drum 201 can be detected by using the transfer roller 204 which contacts the photosensitive drum 201 across a longitudinal direction (a direction perpendicular to a rotation direction). With this processing, since a difference occurs between detected currents depending on whether there is a scratch or a pinhole on one area in a longitudinal direction of the photosensitive drum 201, the abnormality on the photosensitive drum 201 can be detected.

Figure 11:
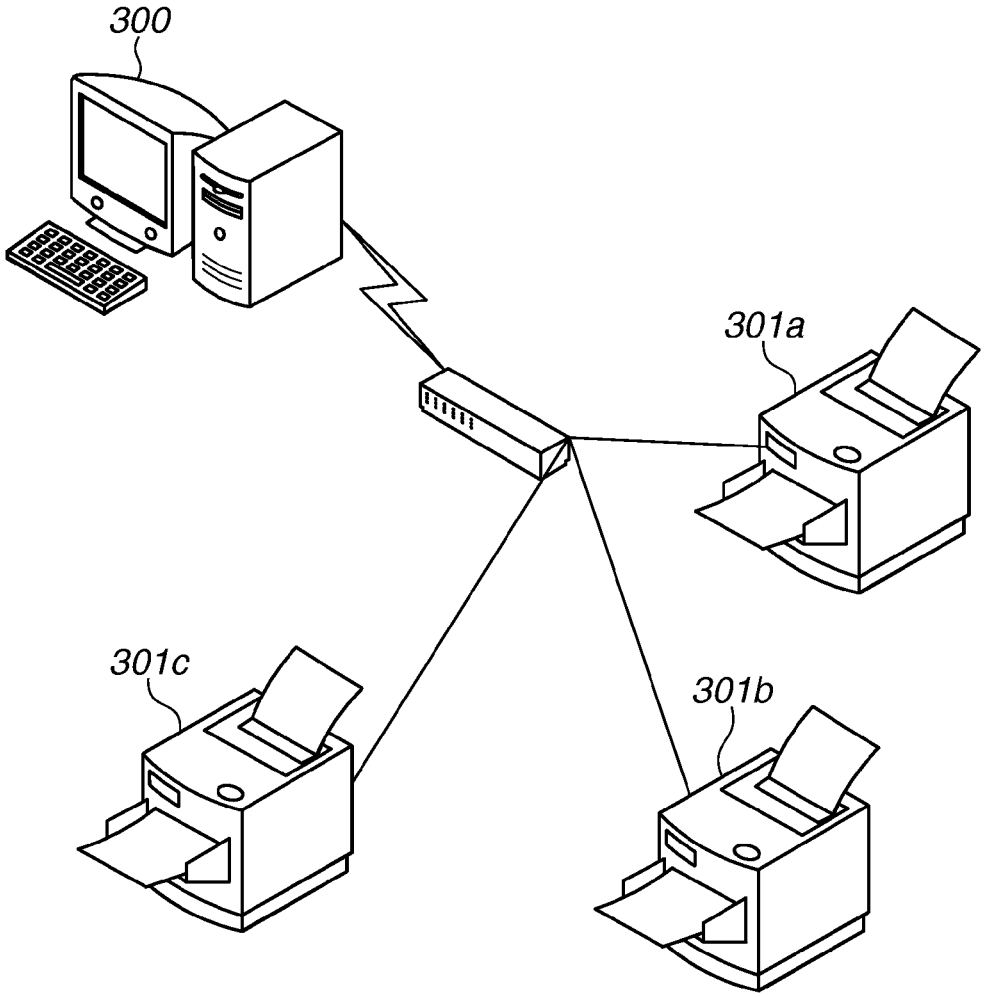
FIG. 11 is a schematic diagram illustrating an image forming system according to an exemplary embodiment.

The lifetime determination result and the abnormality detection result described in the first and second exemplary embodiments can be notified to a computer in a sales office or a dealer through a network. This enables services to be provided according to usage state of users. For example, in an environment as illustrated in FIG. 11, a computer 300 of a sales office is connected to a plurality of printers 301*a*, 301*b*, and 301*c* via networks. In such an environment, each of the printers 301*a*, 301*b*, and 301*c* can notify the computer of the sales office or the dealer of a detection result thereof via the network. The sales office can provide a new consumable product in a timely manner in response to the notification.

The use of such a network system (image forming system) including the computer 300 and the printers 301*a*, 301*b*, and 301*c* can optimize management and shipping of consumable products on the sales office side. For example, the computer 300 may acquire information about how the photosensitive drum is used by a user as described in the first exemplary embodiment from each of the printers 301*a*, 301*b*, and 301*c* through the networks, so that the sales office side can optimize preparation for consumable product shipment according to the usage state. The network can be wired or wireless.

For example, the computer 300 acquires information about differences in how the photosensitive drum is used by a user as described above in FIG. 6A via the network, the information including surface potentials at drive time Tb for the respective lines "a", "b", and "c" illustrated in FIG. 6A. Then, the computer 300 calculates a difference between a surface potential Vd and a threshold value Vx at the time Tb for each line, and determines whether the usage matches any of the lines "a", "b", or "c". If the usage state matches the line "b", the computer 300 determines that a process cartridge should be shipped promptly. If the usage state matches the line "a" or "c", the computer 300 determines a shipping date according to the usage state. Alternatively, the information to be notified to the computer 300 may include information indicating a result determined by the printer side, information indicating a surface potential, and a detection result (e.g., information of a discharge current, information of voltage). Each of such information may be transmitted to the computer 300 as it is. The computer 300 determines a state of a process cartridge based on the transmitted information to determine a scheduled shipping date for each printer, and outputs the resultant shipping date to a computer of the user. Accordingly, the computer 300 of the sales office can efficiently build a plan for shipment of consumable products on the sales office side. For example, the sale office can notify the user of a scheduled shipping date of a process cartridge based on the built plan. Moreover, a user may use a plurality of printers. In such a case, the sales office can notify the user of a scheduled shipping date according to a usage state of a process cartridge of each of the printers.

Figures 12A, 12B:
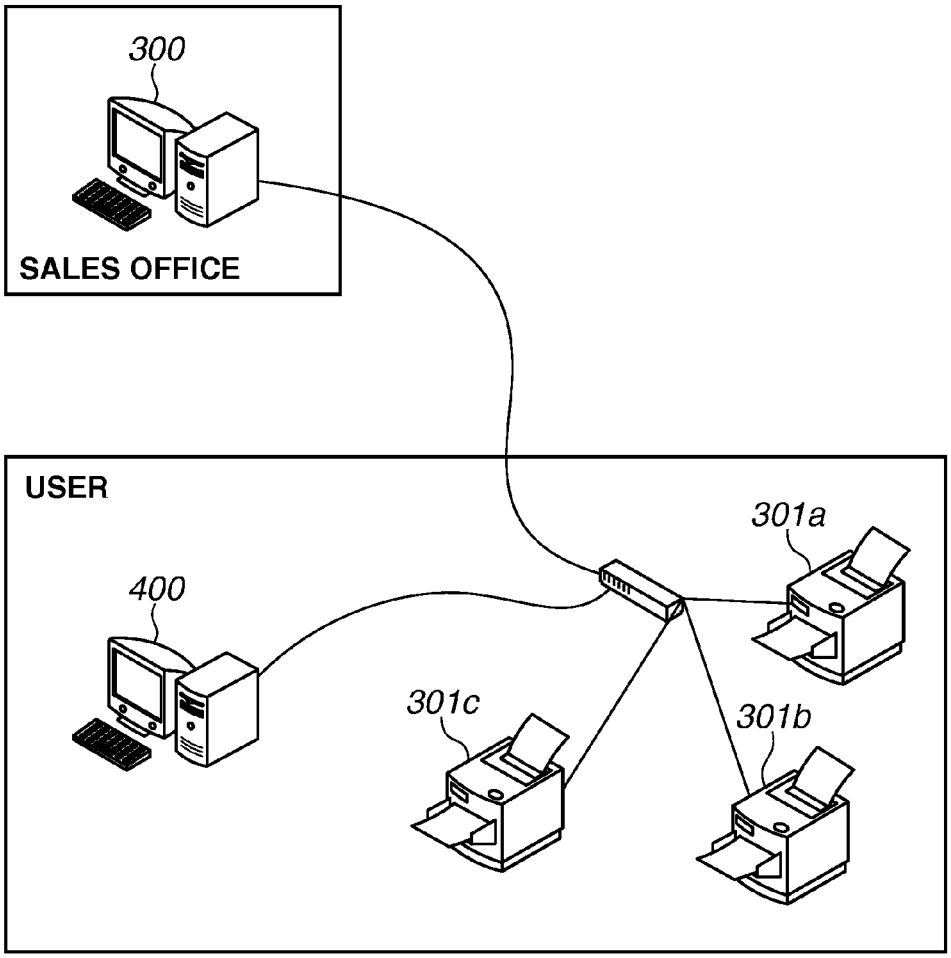
FIGS. 12A and 12B are diagrams illustrating an example of the image forming system and an example of information to be output to a personal computer (PC) of a user according to an exemplary embodiment, respectively.

FIGS. 12A and 12B are diagrams respectively illustrating an example of an image forming system and an example of information to be output to a personal computer (PC) of a user according to an exemplary embodiment.

As illustrated in FIG. 12A, the image forming system includes a computer 300 of a sales office, a computer 400 of a user, and printers 301*a*, 301*b*, and 301*c*. The computer 300 is connected to the computer 400 and the printers 301*a*, 301*b*, and 301*c* via networks.

For example, the computer 300 of the sales office outputs information of scheduled dates of process cartridge shipments to the computer 400 of the user according to differences in usage states of the process cartridges of the respective printers 301*a*, 301*b*, and 301*c*. The user can efficiently replace the process cartridge of each of the printers 301*a*, 301*b*, and 301*c* with new one based on the information from the sales office. Meanwhile, the sales office can ship each of the cartridges of the printers 301*a*, 301*b*, and 301*c* according to the plan.

Therefore, the image forming system including a plurality of printers and a computer of a sales office can provide services according to a usage state of each of the plurality of printers. This can enhance usability. Moreover, the sales office can optimize timing of process cartridge shipment, thereby suppressing unnecessary shipment.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-262771, filed Dec. 19, 2013, and No 2014-211867, filed Oct. 16, 2014, which are hereby incorporated by reference herein in their entirety.

What is claimed is:

1. An image forming apparatus comprising:

an image bearing member;

a process member configured to act on the image bearing member;

a voltage application unit configured to selectively output a voltage having positive polarity and a voltage having negative polarity to the process member;

a current detection unit configured to detect an electric current that flows to the image bearing member; and a control unit configured to determine a first voltage to start discharge between the image bearing member and the process member from the detection result acquired by the current detection unit when the voltage having the positive polarity is applied to the process member, to determine a second voltage to start discharge between the image bearing member and the process member from the detection result acquired by the current detection unit when the voltage having the negative polarity is applied to the process member, and to calculate the surface potential based on the determined first voltage and the determined second voltage, wherein the control unit determines whether a surface of the image bearing member has an abnormality based on the calculated surface potential.

2. The image forming apparatus according to claim 1, wherein, the control unit determines a surface potential of the image bearing member to be abnormal based on a detection result acquired by the current detection unit when the calculated surface potential is less than a threshold value.

3. The image forming apparatus according to claim 2, wherein the abnormality includes a scratch or a pinhole on the image bearing member.

4. An image forming system comprising:

an image forming apparatus; and a computer connected to the image forming apparatus, wherein the image forming apparatus comprises:

an image bearing member;

a process member configured to act on the image bearing member;

a voltage application unit configured to selectively output a voltage having positive polarity and a voltage having negative polarity to the process member;

a current detection unit configured to detect an electric current that flows to the image bearing member; and a control unit configured to determine a first voltage to start discharge between the image bearing member and the process member from the detection result acquired by the current detection unit when the voltage having the positive polarity is applied to the process member, to determine a second voltage to start discharge between the image bearing member and the process member from the detection result acquired by the current detection unit when the voltage having the negative polarity is applied to the process member, and to calculate the surface potential based on the determined first voltage and the determined second voltage, wherein the computer determines whether a surface of the image bearing member has an abnormality based on the calculated surface potential.

5. The image forming system according to claim 4, wherein the image bearing member and the process member are attachable to and detachable from the image forming apparatus as an integrated cartridge, and wherein, when the computer determines that the image bearing member reaches end of lifetime based on a comparison between the calculated surface potential and a threshold value, the computer outputs information about replacement of the integrated cartridge.

6. The image forming system according to claim 5, wherein the information about replacement of the integrated cartridge includes a scheduled shipping date of a cartridge.

7. The image forming system according to claim 5, wherein the computer determines a usage amount of the image bearing member based on a comparison between the calculated surface potential and a threshold value, and outputs the information about replacement of the integrated cartridge based on the determined result.

8. The image forming apparatus according to claim 1, wherein the process member includes a transfer member configured to transfer an image formed on the image bearing member to a sheet.

9. The image forming system according to claim 4, wherein the process member includes a transfer member configured to transfer an image formed on the image bearing member to a sheet.

* * * * *